US005507421A

United States Patent [19]

Keeton

[11] Patent Number: 5,507,421

[45] Date of Patent: Apr. 16, 1996

[54] TURN AND CUT MACHINE FOR REVERSE-FOLDING TUBULAR TEXTILE MATERIAL AND METHODS OF OPERATION

[76] Inventor: Herbert Keeton, c/o P.O. Box 296, 747 Meader St., Campbellsville, Ky. 42719

[21] Appl. No.: 161,794

[22] Filed: Dec. 6, 1993

[51] Int. Cl.[6] ..... A41H 43/00

[52] U.S. Cl. ..... 223/39; 223/40; 223/41; 223/42

[58] Field of Search ..... 28/100; 223/39, 223/40, 41, 42; 493/395, 465

[56] References Cited

U.S. PATENT DOCUMENTS

| | | | |
|---|---|---|---|
| 775,975 | 11/1904 | Iverson | 223/43 |
| 3,310,207 | 3/1967 | Gore | 223/39 |
| 3,357,609 | 12/1967 | Oberrecht | 223/39 |
| 3,568,898 | 3/1971 | Griffin | 223/43 |
| 3,603,488 | 9/1971 | Klampenborg | 223/40 |
| 3,802,157 | 4/1974 | Elms | 53/385 |
| 4,643,340 | 2/1987 | Bailey | 223/40 |
| 4,739,910 | 4/1988 | Westphal et al. | 223/40 |
| 5,127,558 | 7/1992 | Paolo | 223/40 |

*Primary Examiner*—C. D. Crowder
*Assistant Examiner*—Bibhu Mohanty
*Attorney, Agent, or Firm*—Nixon & Vanderhye

[57] ABSTRACT

The turn and cut machine includes a feed tray for advancing flat tubular feedstock textile material. Grippers open the leading end of the tubular material to define an opening. Clamp elements are advanced into the opening to clamp opposite side portions of the feedstock and space the side portions laterally outwardly of the margins of the tubular feedstock. Feed trays advance the feedstock through the leading edge opening, reverse-folding the material onto itself. The feed of the material is stopped while the trays continue to advance to peel the clamped portion from the clamp assemblies. The trays are withdrawn and a guillotine blade cuts the reverse-folded textile material.

13 Claims, 14 Drawing Sheets

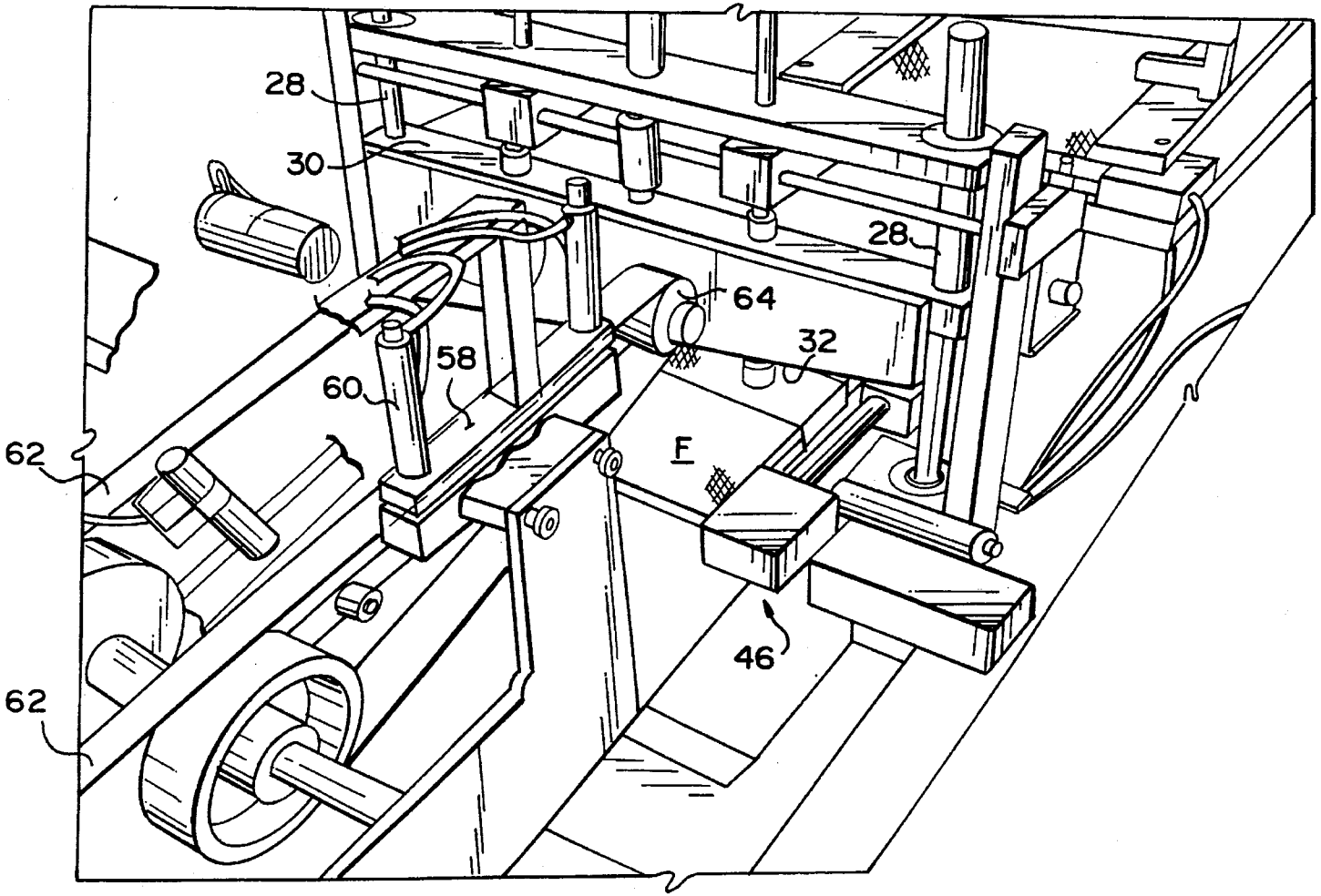
FIG. IB

FIG. 1C
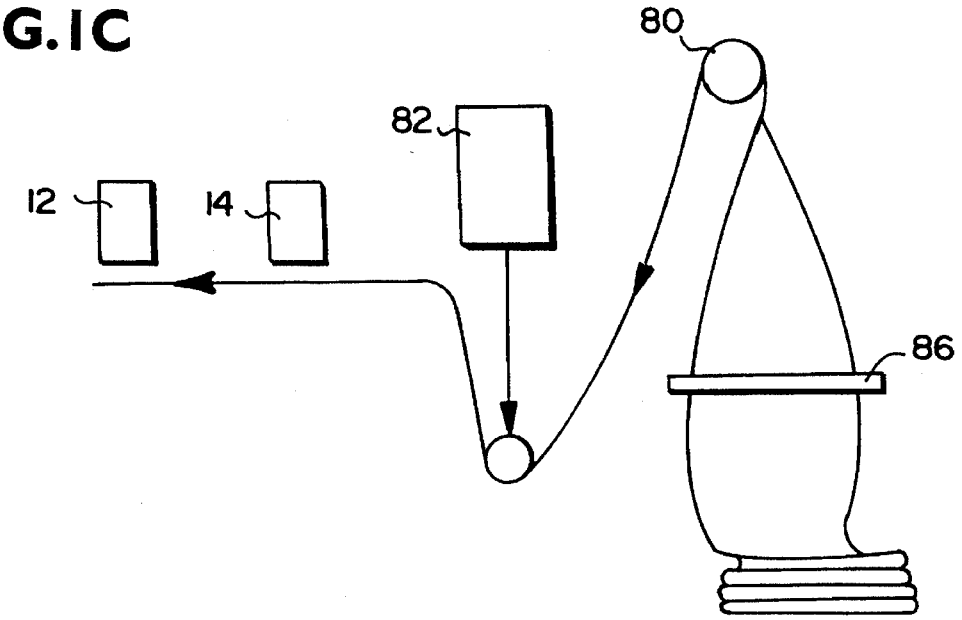
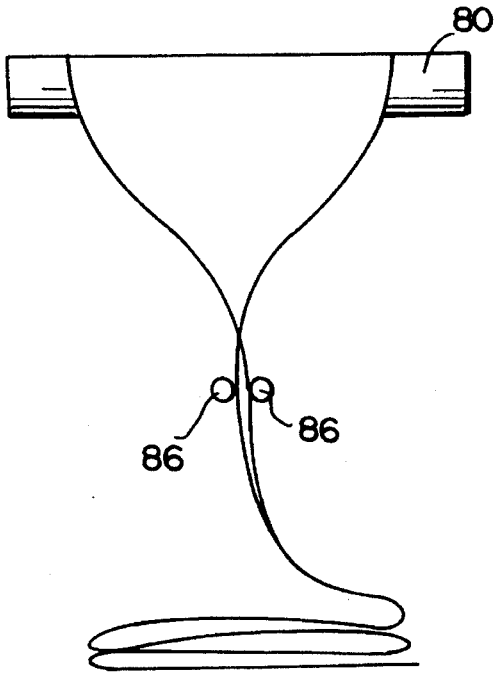
FIG. 1D

TURN AND CUT MACHINE FOR REVERSE-FOLDING TUBULAR TEXTILE MATERIAL AND METHODS OF OPERATION

TECHNICAL FIELD

The present invention relates to a machine for reverse-folding textile material onto itself and subsequently cutting the reverse-folding textile material to form, for example, cuffs, turtlenecks, waistbands and the like and to methods of operation of the machine.

BACKGROUND

In the textile industry, the turning of textile materials, such as woven or non-woven fabrics, to form reverse folded material and to subsequently cut the reverse-folded material to form cuffs, turtlenecks, waistbands and the like is currently accomplished most inefficiently. Industry practice has been primarily to manually turn tile tubular material to form the cuffs and the like. As can be readily recognized, this can be a bottleneck to the efficient, high-speed production of these types of textile products. To my knowledge, there has not heretofore been provided a machine capable of reverse-folding a tubular textile product to adjustable lengths and widths and cutting the product from the tubular feedstock material in any way which accomplishes those tasks efficiently and at high-speed production rates.

DISCLOSURE OF THE INVENTION

In accordance with the present invention, there is provided a turn and cut machine which can efficiently and at high production speeds reverse-fold onto itself tubular feedstock material fed to the machine and cut the reverse-folded material to form cuffs, turtlenecks, waistbands and the like. To accomplish this, there is provided a feed element or tray for conveying tubular feedstock material in a flattened form through the machine where the material is reverse-folded onto itself and cut to selecfed lengths and widths. The feed tray carries a clamp which, when open, enables the material to be conveyed to a turn and cut station, including a guillotine knife edge for cutting the reverse-folded material. A pair of gripper assemblies are provided for separating a portion of the flat tubular material at its leading edge from an opposite portion to define a leading edge opening. Gripping elements or fingers are provided for movement into the open end of the material to engage opposed portions thereof. For example, when the material has been conveyed to the turn and cut station, the gripper assemblies engage an upper portion of the upper flat layer of the tubular material to separate it from the underlying flat portion of the tubular material to define a leading edge opening. Air blowers are used to further enlarge the opening. Gripping elements are then disposed into the opening to engage opposed portions of the opening and expand or laterally enlarge the opening to such an extent that the opposed portions lie outwardly of the margin of the flat tubular feedstock material. When the opening has been enlarged in this manner, the material feeding element or tray is advanced to advance the tubular feedstock material along the predetermined path into and through the opening at the leading edge of the tubular material and between the opposed portions thereby causing the material to reverse-timid onto itself. While the feed tray is advancing to cause the reverse-folding of the material, the gripping elements remain stationary, holding back the leading edge portions of the material defining the opening.

When the feedstock tubular material has been fed a predetermined distance through the leading edge opening, and with the gripping elements holding the opposed portions of the leading edge of the material stationary, the feedstock material is clamped and prevenfed from further advancement. However, the feeding element or tray continues to advance, peeling the opposed portions of the leading edge from the gripping elements such that a predetermined length of the feedstock material has been reverse-folded onto itself. When the leading edge material is completely peeled from the gripping elements, a clamp engages the reverse-folded material. The feed tray is then withdrawn from within the reverse-folded material. The gripping elements are also withdrawn in the direction of the advancement of the material to a location out of alignment with the guillotine knife edge. Upon full withdrawal, the guillotine knife edge is actuafed to cut the material, severing the reverse-folded material from the tubular feedstock material. Once cut, the reverse-folded material is carried away by a discharge conveyor. The material is then made ready to feed forwardly whereby an additional turn and cut cycle may be accomplished.

One of the many problems associafed with the formation of reverse folded material and cutting the material is the need to accomplish that task for various widths of tubular textile material. To facilitate that there is a need for maintaining the centerline of the feedstock material aligned with the centerline of the turn and cut machine. It will be appreciafed that the gripping elements are laterally adjustable in accordance with the width of the tubular textile material but that the material needs to be centered to enable the gripping elements to open the leading edge of the tubular material. To center the material along the machine axis, the material is initially fed from the supply material, e.g. a roll or flat bed, in such manner that the plane of the flat tubular material is aligned with the longitudinal axis or center line of the machine. Once aligned, the material passing through the alinement mechanism makes a 90° turn to pass over a roller system which forms part of the feed mechanism. By aligning the plane of the material with the machine axis and making the quarter turn, the flat material passing over the roller system is automatically maintained in alignment with the longitudinal axis of the machine.

In a preferred embodiment according to the present invention, there is provided a method of reverse-folding tubular textile material onto itself comprising the steps of disposing tubular textile material for advancement along a predetermined path, the material having a leading edge, separating a portion of the tubular material at its leading edge from an opposite portion thereof to define a leading edge opening, disposing gripping elements into the leading edge opening of the material to engage opposed portions thereof, displacing the gripping elements and the opposed portions engaged thereby such that the opposed portions lie outwardly of margins of the tubular material lying along the predetermined path and while the opposed portions lie outwardly of the margins of the tubular material, advancing a material feeding element engageable with the tubular material to advance the tubular material along the predetermined path into and through the leading edge opening and between the opposed portions thereof, thereby causing the material to reverse-fold onto itself.

in a further preferred embodiment according to the present invention, there is provided apparatus for reverse-folding tubular textile material onto itself comprising a frame, a textile feeding element carried by the frame for advancing tubular textile material along a predetermined path, the material having a leading edge defining a leading edge opening and gripping elements carried by the frame for gripping opposed portions of the tubular textile material and displacing the opposed portions outwardly of margins of the tubular material lying along the predetermined path, the textile feeding element being movable to advance the tubular textile material along the predetermined path into and through the leading edge opening thereof and between the gripping elements, thereby causing the material to reverse-fold onto itself.

In a still further preferred embodiment according to the present invention, there is provided apparatus for centering a web of textile material fed from a supply thereof relative to a longitudinal machine axis comprising a member for orienting the web such that the web lies in a vertical plane coincident with a vertical plane passing through the longitudinal machine axis lies and an element orienfed at right angles to the vertical plane of the web to reorient the web such that the center line of the web lies substantially coincident with the longitudinal machine axis when the web is input to the machine.

In a still further preferred embodiment according to the present invention, there is provided a method for centering a web of textile material fed from a supply thereof relative to a longitudinal machine axis comprising the steps of orienting the web such that a plane passing through the web lies in coplanar relation with the longitudinal machine axis and rotating the web from the plane through an angle of about 90° to reorient the web such that the center line of the web lies substantially coincident with the longitudinal machine axis when the web passes through the machine.

Accordingly, it is a primary object of the present invention to provide a novel and improved turn and cut machine for reverse folding tubular textile material onto its self for the formation of turtlenecks, waistbands, cuffs and the like and novel and improved methods of operating the machine.

BRIEF DESCRIPTION OF THE DRAWINGS

FIG. 1B is a top, front perspective view of the machine illustrating its textile product output end;

FIG. 1C is a schematic side elevational view of the textile input end of the machine illustrating a mechanism for centering the textile feedstock relative to the machine;

FIG. 1D is a schematic end view of the centering mechanism of FIG. 1C;

BEST MODE FOR CARRYING OUT THE INVENTION

Reference will now be made in detail to a present preferred embodiment of the invention, an example of which is illustrafed in the accompanying drawings.

Figure 1A:
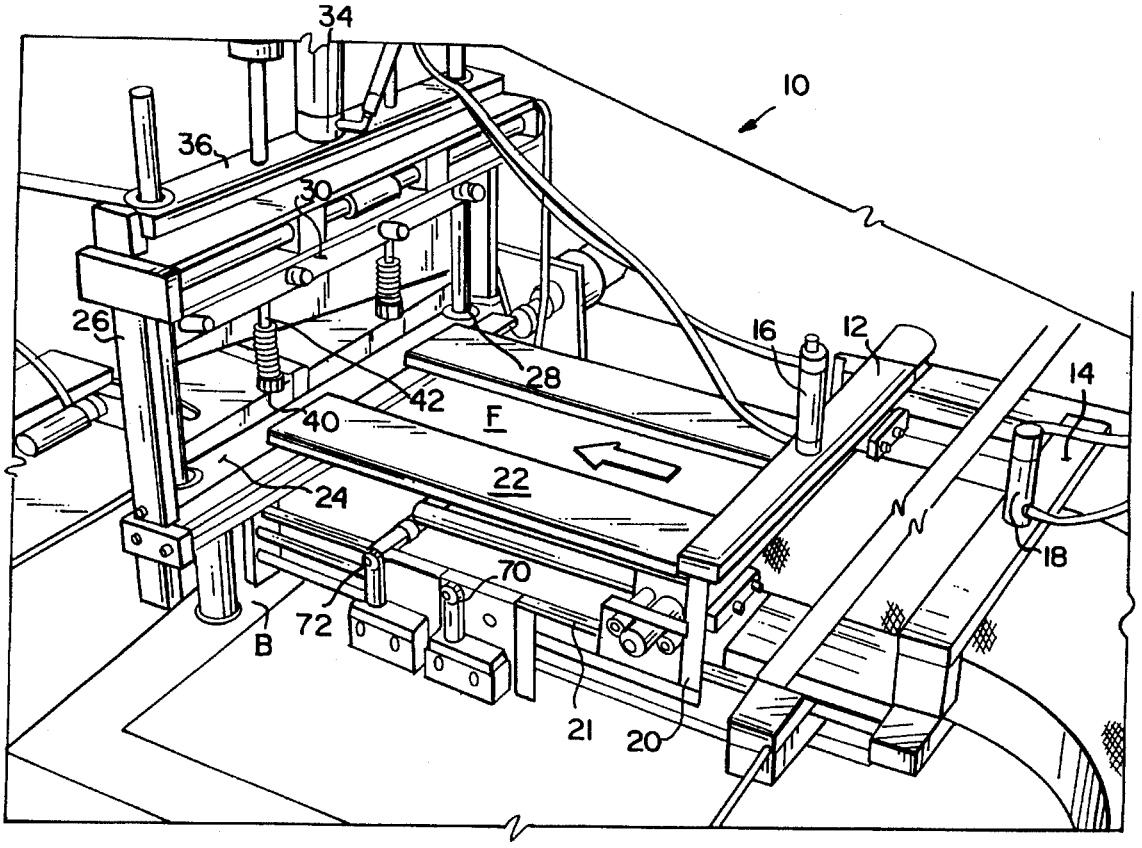
FIG. 1A is a top, front perspective view of a turn and cut machine according to the present invention illustrating the textile input end of the machine.

Referring now to FIGS. 1A and 1B, there is illustrafed a turn and cut machine according to the present invention, generally designafed 10, for reverse-folding textile fabric F supplied to machine 10 in flat, tubular form from a feedstock supply, illustrafed in FIG. 1C and described hereinafter. On the input end of machine 10, there is provided a pair of clamps 12 and 14, each actuafed by a cylinder 16 and 18, respectively. Clamp 12 and its actuating cylinder 16 is carried on a carriage 20 mounfed on a machine frame or base B for longitudinal reciprocating movement in the direction of the arrow along slide bars 21, which is also the direction of advancement of fabric F through machine 10. Carriage 20 also carries laterally spaced feed elements or trays 22 for longitudinal reciprocating movement therewith, the trays 22 having longitudinal slots opening toward one another for receiving the fabric F. Carriage 20 is reciprocafed by a pneumatic actuafed cylinder, not shown. Clamp 14 is fixed to the base B and, for reasons discussed hereafter, clamps the material F to the base while a predetermined length of feedstock material upstream of clamp 14 is centered and prepared for passage through machine 10 as subsequently described herein.

When carriage 20 lies in a retracfed position, the leading or forward ends of feed elements 22 lie adjacent a work platen 24 on which the leading edge of the flat tubular material F rests at the commencement of each turn and cut cycle. The frame or base B mounts a pair of upstanding stanchions 26 which, in turn, carry a pair of laterally spaced, vertically extending guide bars 28. A cross head 30 is mounfed on the guide bars 28 for vertical sliding movement and carries an angled guillotine blade 32 for cooperation with the platen 24 to cut the fabric. A cylinder 34 is mounfed on a crosspiece 36 fixed to stanchions 26 and has a piston rod coupled to the cross head 30 for raising and lowering the guillotine blade 32.

Figure 2A:
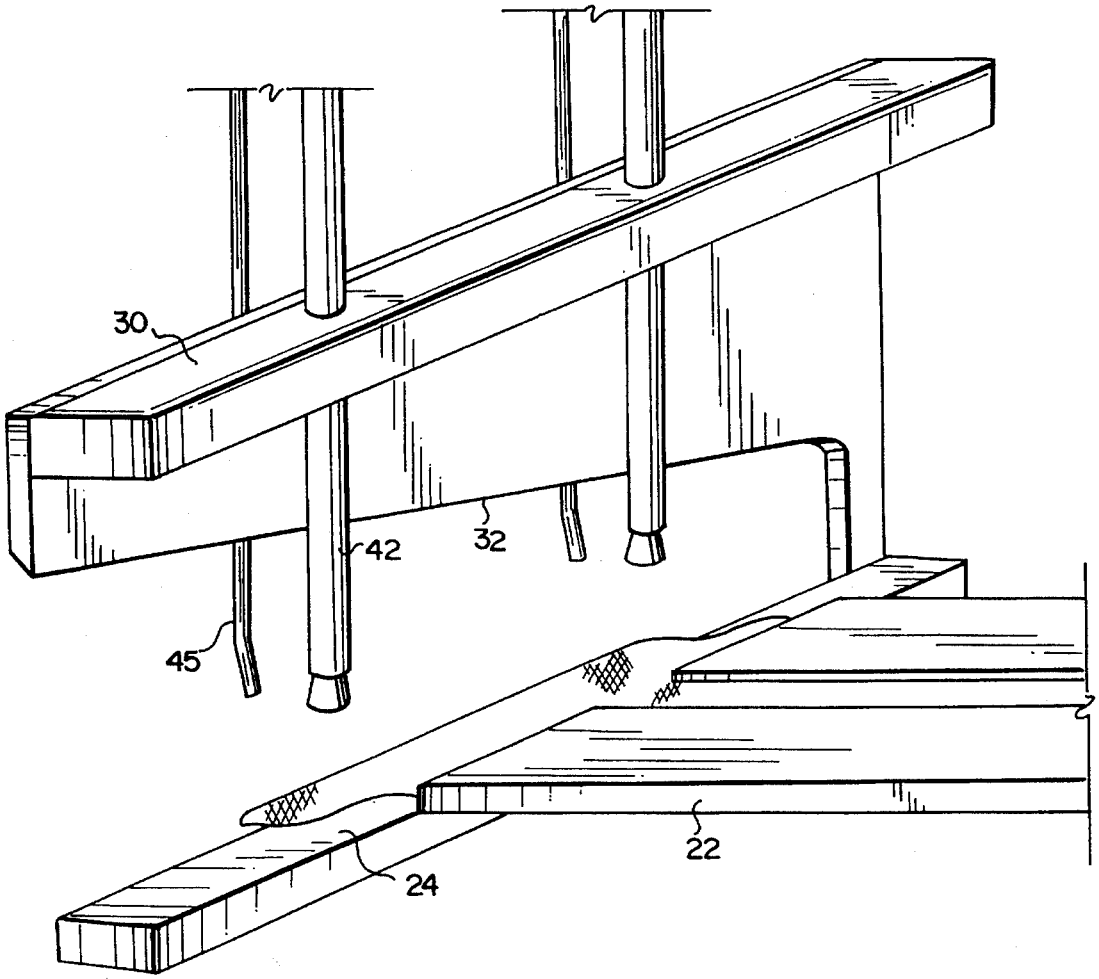
FIGS. 2A, 2B and 2C are schematic perspective views illustrating the textile material cutting and leading edge opening operations.
Figure 2B:
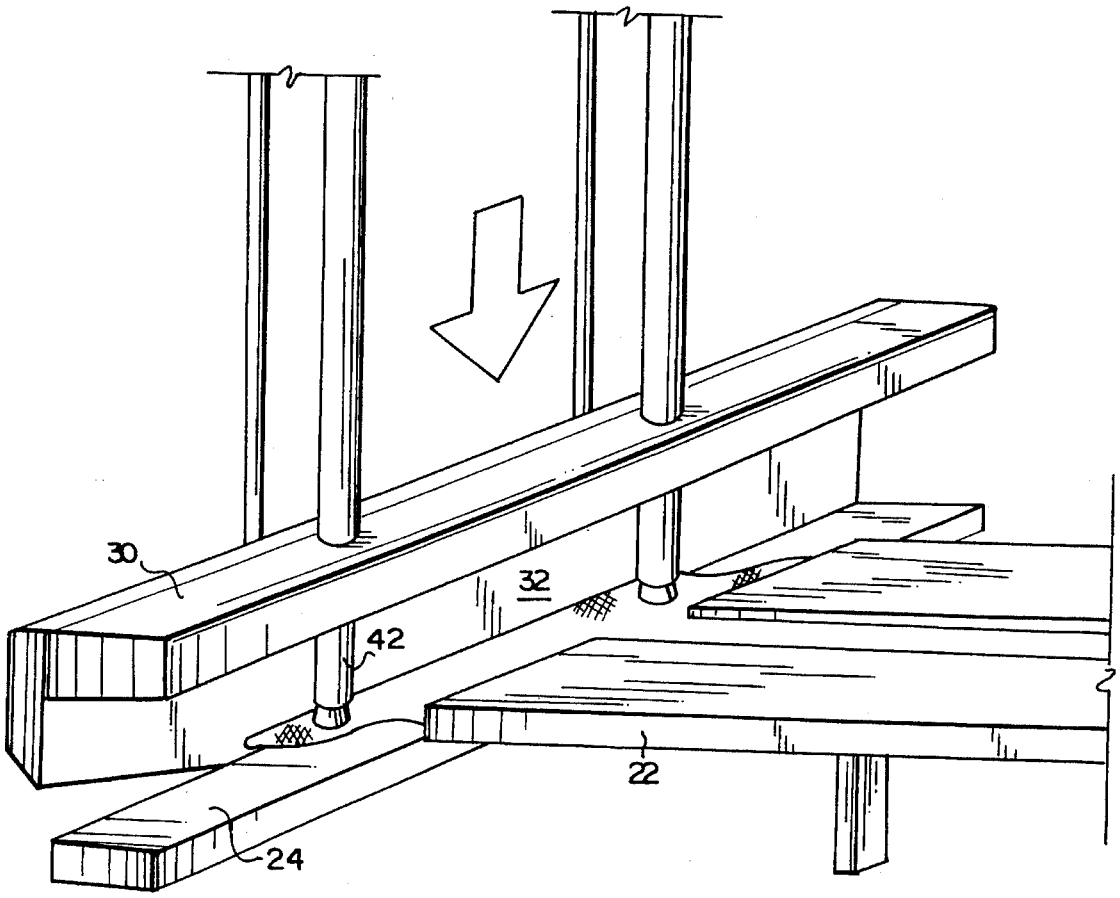
Figure 3A:
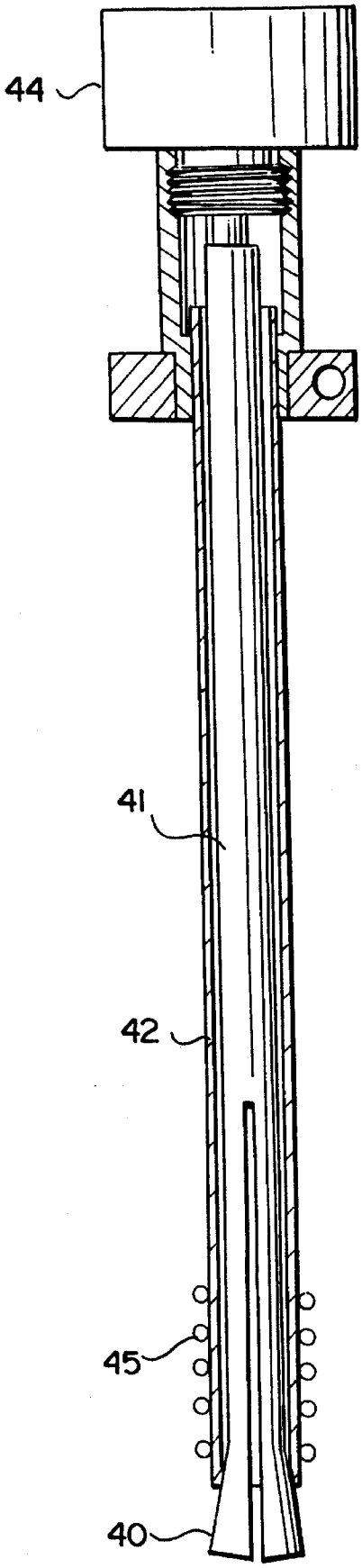
FIG. 3A is an enlarged cross-sectional view of a gripper assembly for opening the leading edge of the tubular textile fabric.
Figure 3B:
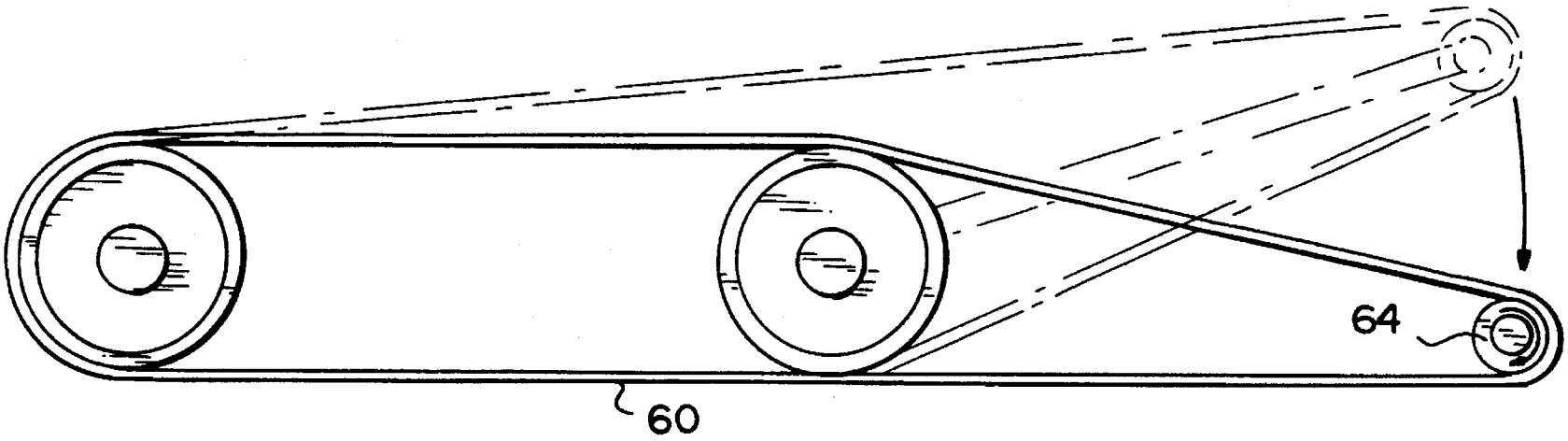
FIG. 3B is an enlarged side elevational view of a discharge conveyor for discharging the turned and cut material from the machine.

A gripper assembly is also carried by the crossbar 36 and includes a depending gripper 40, carried on a shaft 41 within a gripper tube 42, the shaft 41 being under control of an air-actuafed gripper cylinder 44. With reference to FIG. 1A and 3A, the gripper tube 42 is carried by the crosspiece 36 and the shaft extends through the tube to the cylinder 44. A spring 45 is disposed about the lower end of tube. Gripper 40 is movable toward and away from platen 24 to grip and release an upper portion of the flat tubular material lying on platen 24. That is, as the crosshead 30 is displaced downwardly, it engages springs 45 to squeeze the bifurcafed gripper ends together to grasp the upper portion of the flat tubular material. When the crosshead 30 is displaced upwardly, the air cylinders 44 are actuafed to draw the outer tapered surfaces (FIG. 3) of the gripper ends upwardly against the tube end to maintain its grip on the upper portion of the tubular material. In this manner, the grippers displace the flat gripped portion of the tubular material upwardly to separate it from the underlying opposite portion of tubular material to define an opening at the leading edge of the fabric F. As illustrafed in FIG. 2A, air tubes 45 are also spaced on the opposite side of cross head 30 to direct air into the leading edge opening when the upper portion of the fabric material is gripped and elevafed to define the opening. The air facilitates maintaining the opposite portions of the material spaced one from the other.

On the opposite side of machine 10, as illustrafed in FIG. 1B, there is provided an assembly, generally designafed 46, for gripping opposed portions of the fabric material, e.g., along laterally opposite sides of the open leading edge of the flat tubular fabric, to displace the material outwardly of the margins of the flat tubular material carried by feed tray 22. Particularly, gripper assembly 46 is mounfed on the base or frame B for longitudinal reciprocating movement by actuation of a cylinder, not shown. The gripper assembly includes a pair of gripping units adjacent opposite sides of the machine 10, for example, units U1 and U2, as illustrafed in FIGS. 4–12. Each unit U includes a gripper anvil 50 and a finger 52 movable toward and away from anvil 50 by a cylinder 54, preferably pneumatically actuafed, carried by the unit. The gripper anvil 50 and finger 52 are carried within a housing 56 which, in turn, is mounfed for movement in laterally opposite directions under control of a cylinder 58. The anvil 50 and finger 52 project in a longitudinal upstream direction.

Also locafed downstream of platen 24 is a clamp 59 under control of a pair of cylinders 60 (FIG. 1B). The clamp head 59 is locafed, for reasons discussed below, between the two feed trays 22. Clamp head 59 is reciprocable vertically under control of cylinders 60 into and out of engagement with the fabric emerging from platen 24 and between the trays 22. A support surface for the emerging fabric is provided and against which the head 58 clamps the emerging fabric. Further, a pair of discharge belts 62 (FIGS. 1B and 1C) straddle clamp head 59 and cylinders 60 and overlie the material emerging from plate 24. The pulleys are led around a forward roller 64 which is movable between positions engaging the turned product as illustrafed in FIG. 3B to discharge the product from the machine and an elevafed position illustrafed by the dashed lines spaced from the product emerging from platen 24.

Turning back to FIG. 1C, there is illustrafed a feed station for feeding tubular textile material from a supply, e.g. roll or flat stock, to the turn and cut station of the machine. The feed includes a roller bar 80 upstanding from the machine over which the feedstock textile material passes and a cylinder 82 carrying a cylinder roller 84. On actuation of cylinder 82, the roller 84 advances to displace textile feedstock over roller 80. That is, with clamp head 14 closed, cylinder 82 is actuafed to draw feed stock material from the supply (which may be in flat or roll form). When clamp head 14 and 12 are opened, and the roller 84 has been withdrawn by the cylinder 82, the material between the feed tray and roller 80 is available for feed through the turn and cut station.

In order to center the flat tubular feedstock material relative to the longitudinal axis of the machine, whereby tubular feedstock of various widths can be fed to the machine for turning and cutting, the feedstock material is first turned or locafed such that the flat tubular textile material lies in a vertical plane extending through the longitudinal axis of the machine. To accomplish this, the feedstock material is fed between a pair of bars 86 projecting longitudinally rearwardly of the machine. The bars are aligned with the centerline of the machine. The material so aligned is then turned through 90° to pass over the roller 80. With this arrangement, the centerline of the flat material passing over roller 80 is maintained in alignment with the centerline of the machine.

Figure 2C:
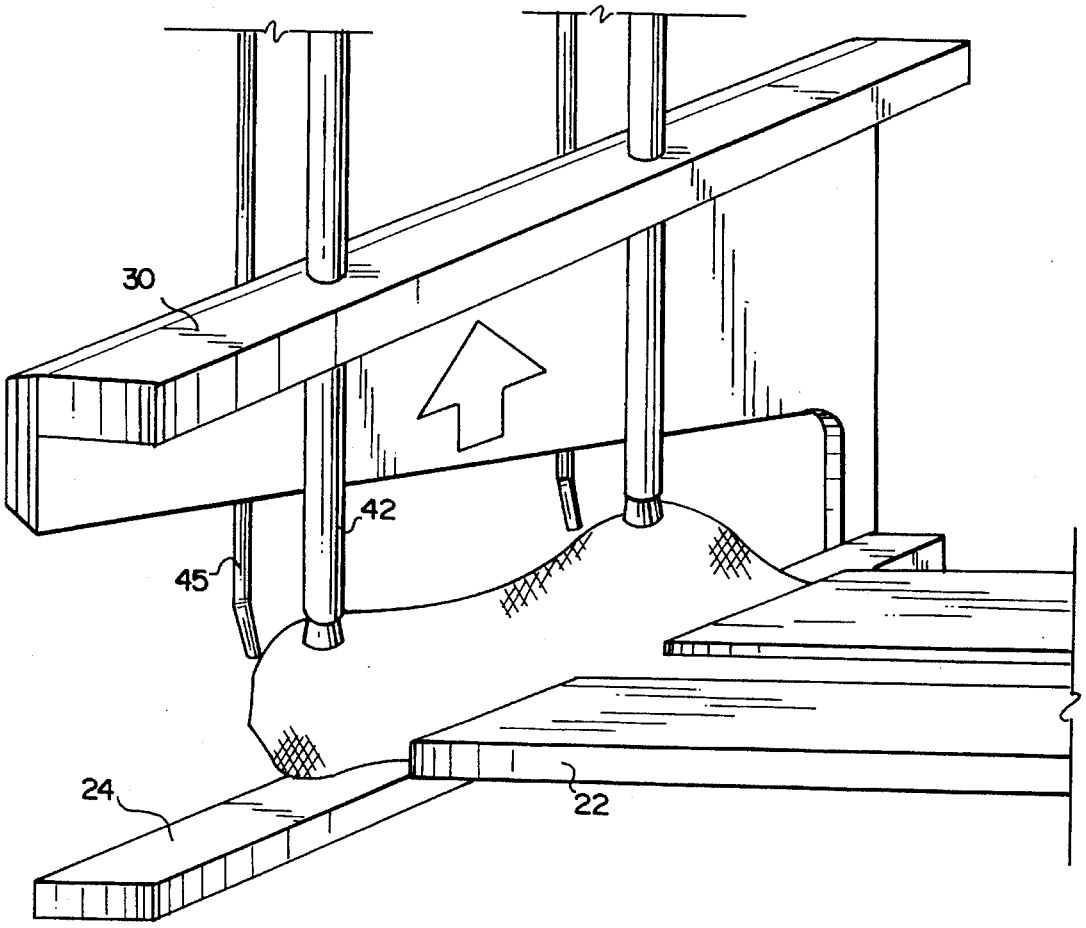

The operation of the machine will now be described, with particular reference to FIGS. 4–12. The centered flat tubular textile fabric F is passed over roller 80, below roller 84 and through clamps 14 and 12 and into the slotfed feed trays 22 (FIGS. 1A and 2A). The textile fabric F is thus disposed in an initial position within feed trays 22 with its leading edge in alignment with the forward edge of platen 24 as illustrafed in FIG. 2A. Cylinder 34 is actuafed to lower the guillotine blade 32 to cut the material overlying the forward edge of platen 24 to square the material edge. Simultaneously, the springs 45 force grippers 40 to close on contact with the upper portion of the folded tubular fabric. The gripper cylinders 44 and cylinder 34 are then actuafed to retract the grippers 40 and blade 32, respectively. As the cylinders retract and the blade is raised, the grippers remain closed by contact with the lower ends of tubes 44 withdrawing the upper portion of the material away from the lower flat portion of the material about the leading edge opening (FIG. 2C). The air tubes 45 blow air into the leading edge opening to force the lower portion of the flat tubular material downwardly to maintain a defined opening in the leading edge of the flat tubular material.

Figure 4:
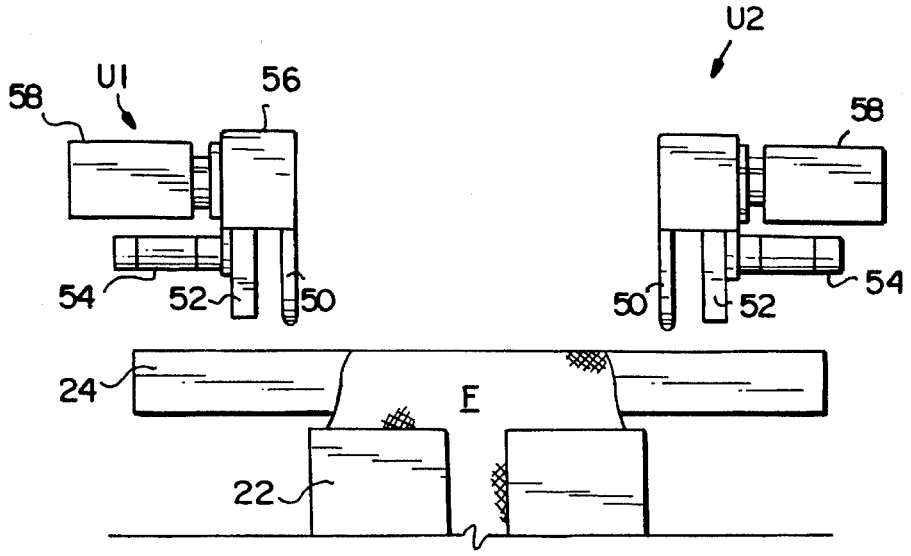
FIGS. 4–12 are schematic illustrations of the sequence of steps for performing the turning and cutting operations hereof.
Figure 5:
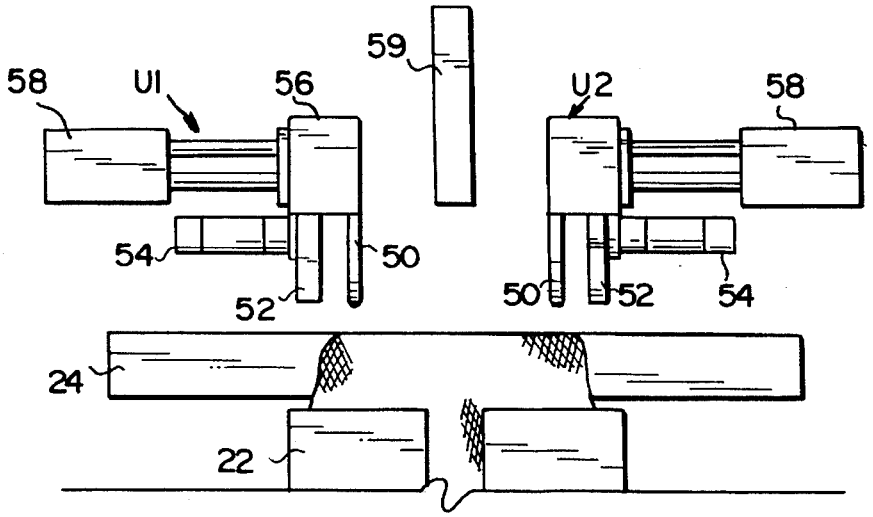
Figure 6:
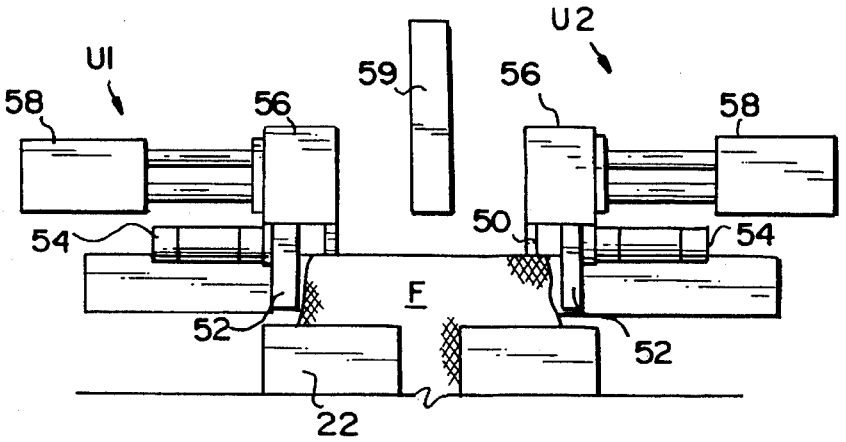
Figure 7:
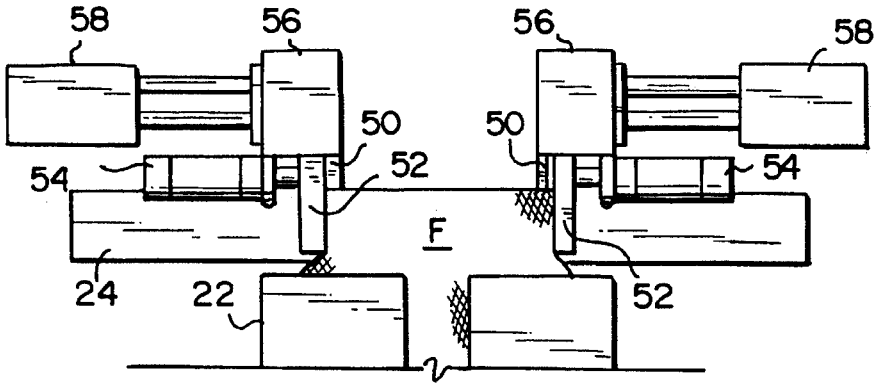

With the opening through the leading edge of the material being now well defined by the grippers and air blowing tubes, it will be appreciafed that the gripping units U1 and U2 are in a retracfed position, as illustrafed in FIG. 4, spaced longitudinally downstream from the now-open leading edge of the material. Thus, FIG. 4 schematically illustrates the forward portion of the tubular material with its leading edge in the open condition. The cylinders 58 are then actuafed to displace the housings 56 inwardly toward one another from opposite sides of the machine. The extension of housings 56 toward one another causes the gripper anvils 50 to lie in longitudinal registry with the leading edge opening of the flat tubular material and adjacent opposite sides of the fabric opening as illustrafed in FIG. 5. The carriage mounting the gripping units U1 and U2 is then advanced by actuation of an air cylinder to displace the gripping units toward platen 24 such that, as illustrafed upon comparing FIGS. 5 and 6, the gripping anvils 50 are moved into the leading edge opening adjacent the opposed sides of the tubular material while fingers 52 lie outside the material of the leading edge opening, i.e., each of the opposed sides of the open tubular material is straddled by anvil 50 and finger 52. Once the gripping anvils 50 are disposed in the leading edge opening, the air supply to air tubes 45 is shut off. Gripper clamp cylinders 54 are extended to engage the gripping fingers 52 against the gripping anvils 50 with the textile material there between as illustrafed in FIG. 7.

Figure 8:
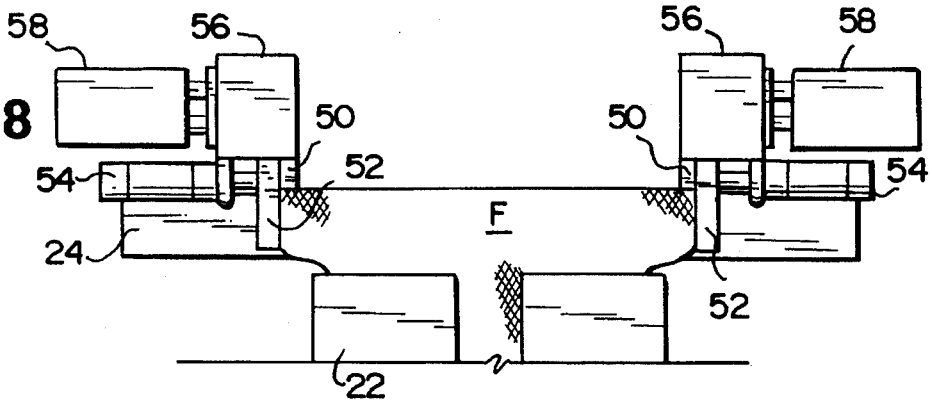
Figure 9:
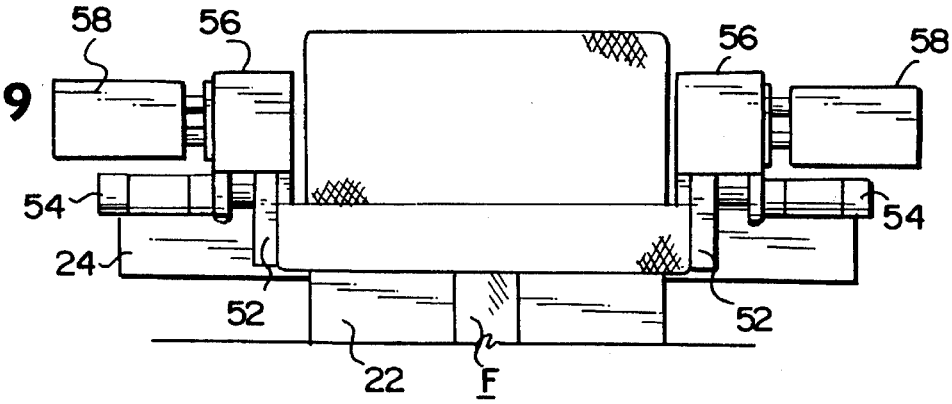
Figure 10:
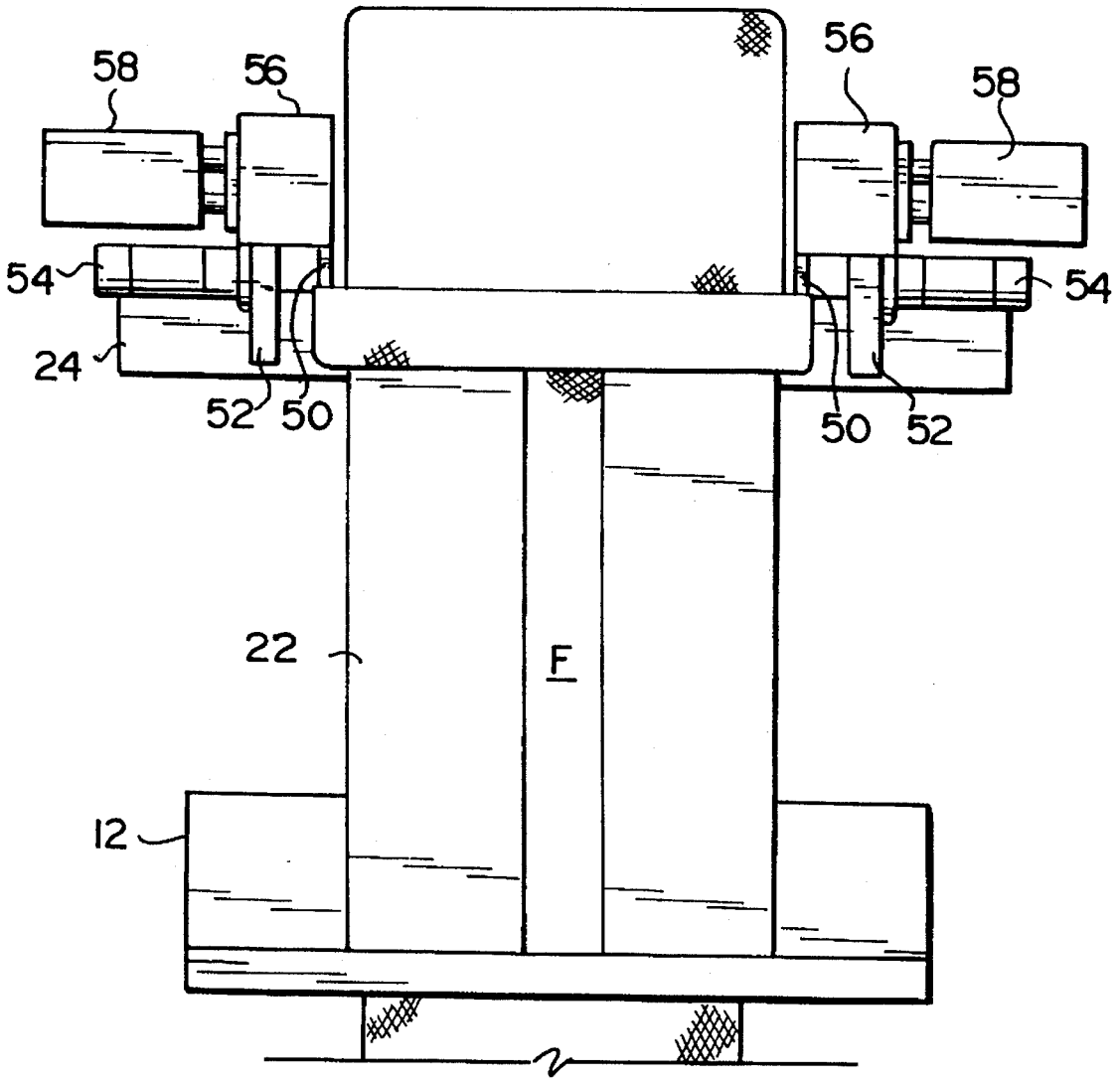
Figure 10A:
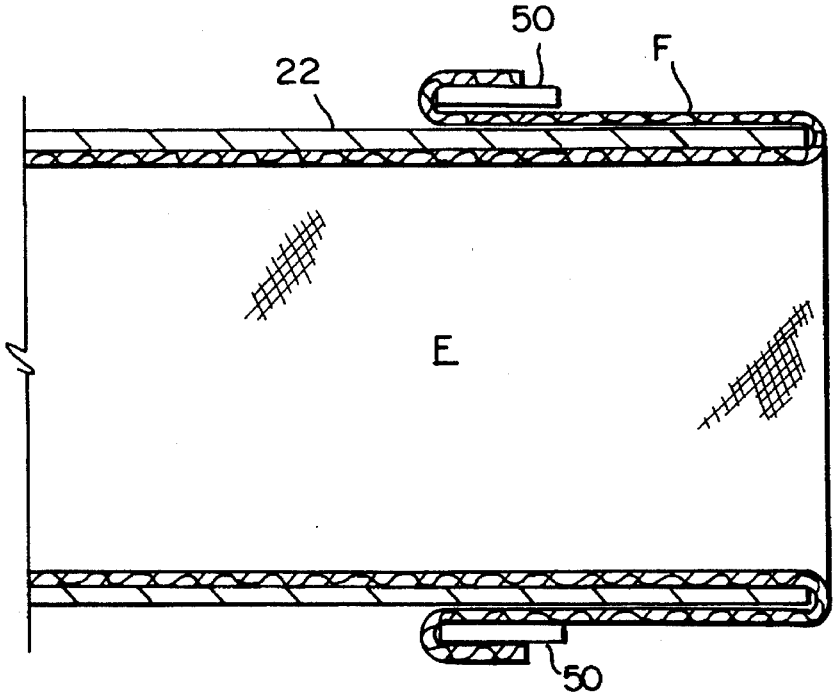
FIGS. 10A and 11A are schematic illustrations of the fabric material as the material is being reverse-folded onto itself and corresponding to the steps illustrafed in FIGS. 10 and 11, respectively.

With the opposed portions of the material gripped between the anvil and finger on opposite sides of the machine, the gripping cylinders 58 are retracfed to transversely extend or stretch the material adjacent the leading edge opening, as illustrafed in FIG. 8. As nofed in that figure, the material is extended such that the anvils 50 and fingers 52 lie outside the margins of the feed trays 22 and outside the margins of the flat tubular feedstock F. At this stage, clamps 12 and 14 are open. As illustrafed in FIG. 9, carriage 20 is advanced with the clamps 12 and 14 open to advance the tubular material carried by trays 22 through the leading edge opening. Particularly, with the fabric opening held between the anvils 50 and fingers 52 along its opposite sides, advancement of carriage 20, particularly trays 22, causes the material to feed through the fabric opening, while the leading edge of the opening of the material is maintained fixed relative to the platen 24. By advancing the feed trays 22 through the opening, it will be appreciafed that the material carried by the feed trays 22 will be folded over the outer surface of feed trays 22, while the material along the inner surfaces of trays 22 is being advanced by the forward motion of the trays 22, as illustrafed in FIGS. 9, 10 and 10A. That is, with reference to FIG. 10A, the collar of the reverse-folded material is held by anvils 50, while the material feeds forwardly along and relative to interior surfaces of the feed trays 22 and the material exterior of the feed trays 22 is held stationary relative to platen 34 by anvils 50 as trays 22 advance.

As the feed trays 22 advance, carriage 20 engages first limit switch 70 carried on base B (FIG. 1B). Actuation of limit switch 70 causes the gripper clamp cylinders 54 to retract, releasing the opposed portions of the fabric previously clamped between anvils 50 and fingers 52. Additionally, switch 70 causes actuation of clamp cylinder 16 to extend clamp 12 against the fabric, preventing further feed of the fabric relative to the feed trays 22, and actuation of clamp cylinder 18 to extend clamp 14 against the fabric to prevent reverse travel of the feedstock when another length thereof is prepared for feed toward machine 10.

Figure 11A:
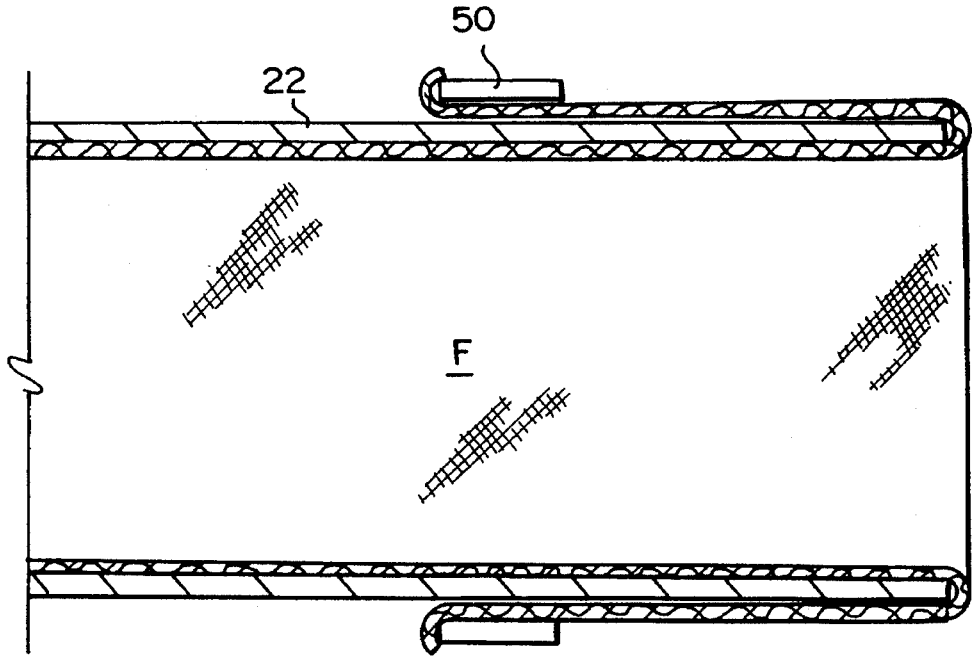
Figure 11:
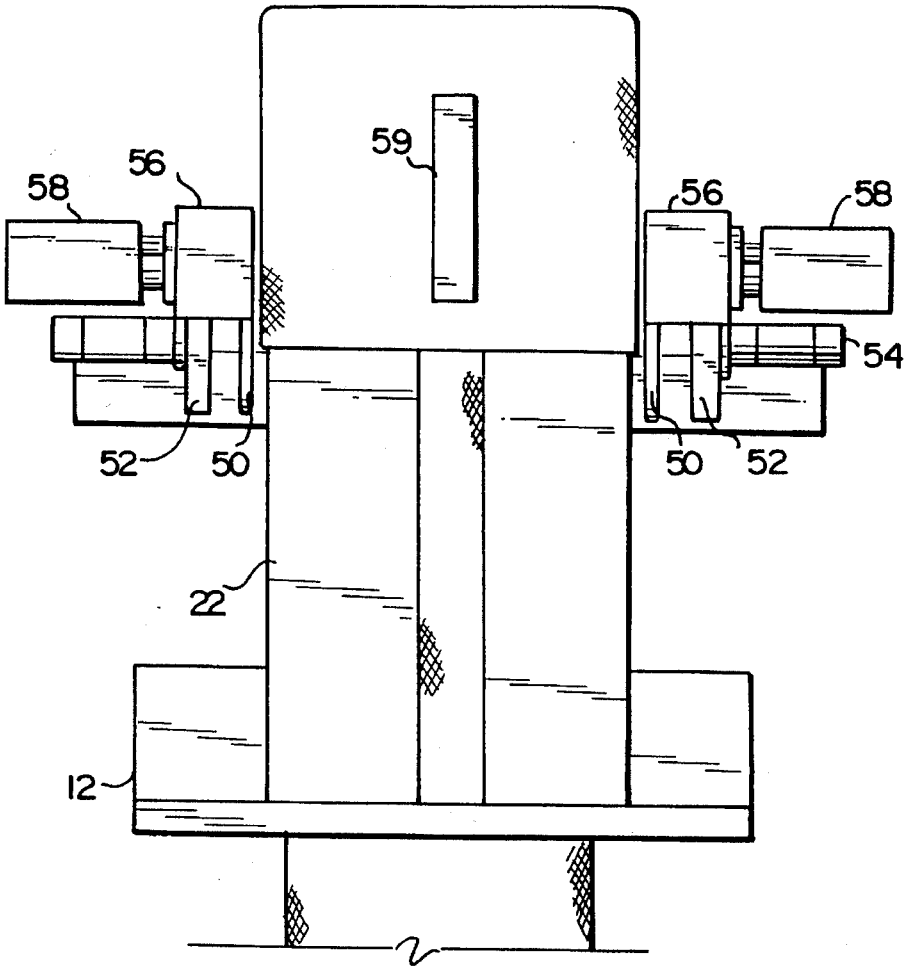
Figure 12:
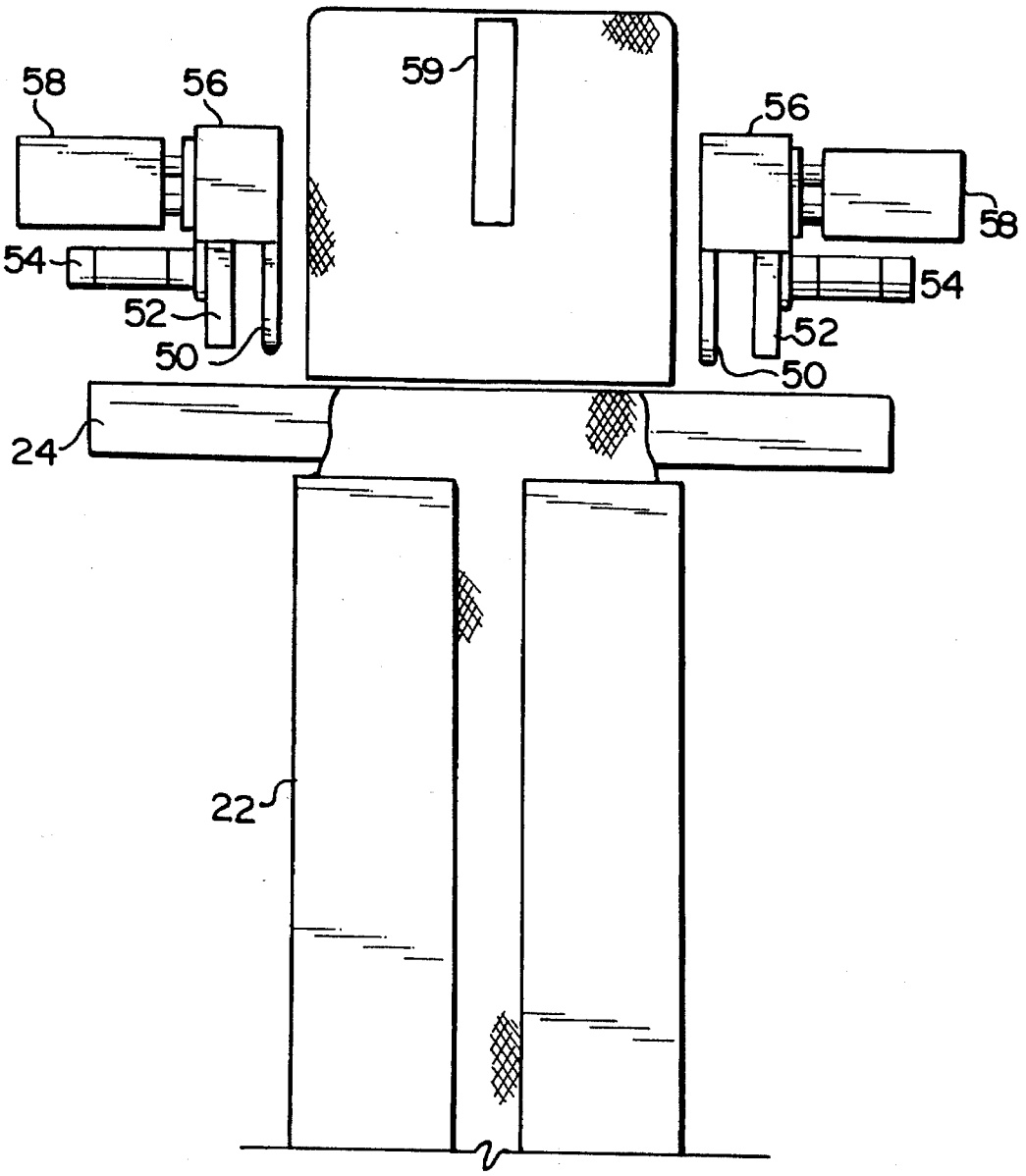

When the feed tray clamp 12 is closed, it prevents any further feeding of the material relative to feed trays 22. With the gripper anvils 50 fixed in their longitudinal positions, further continued advancement of the feed trays 22 causes the collar to peel off anvils 50 as the forward motion of the trays 22 continues with the material feed stopped. The carriage 20 continues to move forwardly until the collar is completely peeled from anvils 50 (FIG. 11A) and a limit switch 72 (FIG. 1A) is engaged by the carriage. Limit switch 72 causes cylinder 16 to retract, thereby disengaging clamp 12 from the fabric. Switch 72 also causes cylinders 60 to extend thereby engaging clamp head 59 against the reverse-folded tubular fabric on the downstream side of platen 24. The clamp head 59 engages the fabric between the trays 22 and maintains that fabric in the advanced position while the carriage 20 is retracfed, causing the feed trays to withdraw back through the leading edge opening of the now reversely folded tubular fabric. Additionally, limit switch 72 causes the carriage mounting the gripping units U1 and U2 to retract to the position illustrafed in FIG. 4.

With the fabric reverse-folded onto itself and a predetermined quantity thereof lying on the downstream side of platen 24, cylinder 34 is actuafed to lower the guillotine blade 32 to cut the material at the forward edge of platen 24. After blade 32 has cut the material, the forward pulley 64 of the discharge belts 62 is lowered to engage the turned and cut product to transport the product away from the platen 24. The feed and cut cycle is then ready to cut another product.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A method of reverse-folding tubular textile material onto itself comprising the steps of:

disposing tubular textile material for advancement along a predetermined path, the material having a leading edge;

separating a portion of the tubular material at its leading edge from an opposite portion thereof to define a leading edge opening;

disposing gripping elements into the leading edge opening of the material to engage opposed portions thereof;

displacing said gripping elements and said opposed portions engaged thereby such that said opposed portions lie outwardly of margins of the tubular material lying along the predetermined path;

while said opposed portions lie outwardly of the margins of the tubular material, advancing a material feeding element engageable with the tubular material to advance the tubular material along the predetermined path into and through the leading edge opening and between the opposed portions thereof, thereby causing the material to reverse-fold onto itself; and stopping the advancement of the tubular material through the leading edge opening while maintaining the opposed portions of the tubular material engaged by the gripping elements and thereafter advancing the feeding element further through said leading edge opening while the tubular material remains stopped from advancement through the leading edge opening to remove the opposed portions of the material from the gripping elements.

2. A method according to claim 1 wherein the tubular material is advanced along the predetermined path in a flat condition with the opposite portions lying in adjacent, generally parallel planes, and including separating the opposite portions of the flat tubular material at the leading edge in a direction generally perpendicular to said planes, and displacing the opposed portions in a direction generally parallel to said planes.

3. A method according to claim 1 including displacing the gripping elements into said opening in a direction generally opposite to the direction of advancement of the material along said predetermined path to engage the opposed portions of the material.

4. A method according to claim 1 wherein the step of separating the opposite portions includes blowing air into the leading edge opening.

5. Apparatus for reverse-folding tubular textile material onto itself comprising:

a frame;

a textile feeding element carried by said frame for advancing tubular textile material along a predetermined path, the material having a leading edge defining a leading edge opening;

means for initially separating an overlying portion of the tubular material along its leading edge from an opposite underlying portion thereof to space the overlying and underlying portions from one another;

gripping elements carried by said frame for gripping opposed portions of the tubular textile material and displacing said opposed portions outwardly of margins of the tubular material lying along said predetermined path;

said gripping elements being carried for movement by said frame in a direction opposite to the direction of advance of the tubular textile material along the predetermined path for insertion into the leading edge between the spaced overlying and underlying portions and for movement in a direction normal thereto to move said opposed portions of the tubular textile material outwardly of the margins of the tubular material lying along the predetermined path; and said textile feeding element being movable to advance the tubular textile material along said predetermined path into and through the leading edge opening thereof and between said gripping elements, thereby causing the material to reverse-fold onto itself.

6. Apparatus according to claim 4 including a blade for cutting the reverse folded textile material, and means for retracting said feeding element to one side of said blade to enable the blade to cut the material.

7. Apparatus according to claim 6 including means for holding the cut reverse folded tubular textile material in an advanced location relative to another side of said cutting blade as said feeding element is retracfed to said one side of said blade.

8. A method of reverse-folding tubular textile material onto itself comprising the steps of:

disposing tubular textile material for advancement along a predetermined path, the material having a leading edge;

separating a portion of the tubular material at its leading edge from an opposite portion thereof to define a leading edge opening;

disposing gripping elements into the leading edge opening of the material to engage opposed portions thereof;

displacing said gripping elements and said opposed portions engaged thereby such that said opposed portions lie outwardly of margins of the tubular material lying along the predetermined path;

while said opposed portions lie outwardly of the margins of the tubular material, advancing a material feeding element engageable with the tubular material to advance the tubular material along the predetermined path into and through the leading edge opening and between the opposed portions thereof, thereby causing the material to reverse-fold onto itself; and withdrawing the material feeding element back through the leading edge opening of the tubular material leaving the tubular material displaced through the opening at the leading edge reverse-folded onto itself, and cutting the tubular material to separate the folded material from unfolded tubular material.

9. A method of reverse-folding tubular textile material onto itself comprising the steps of:

disposing tubular textile material for advancement along a predetermined path, the material having a leading edge;

separating a portion of the tubular material at its leading edge from an opposite portion thereof to define a leading edge opening;

disposing gripping elements into the leading edge opening of the material to engage opposed portions thereof;

displacing said gripping elements and said opposed portions engaged thereby such that said opposed portions lie outwardly of margins of the tubular material lying along the predetermined path;

while said opposed portions lie outwardly of the margins of the tubular material, advancing a material feeding element engageable with the tubular material to advance the tubular material along the predetermined path into and through the leading edge opening and between the opposed portions thereof, thereby causing the material to reverse-fold onto itself; and stopping the advancement of the tubular material through the leading edge opening while maintaining the opposed portions of the tubular material engaged by the gripping elements and thereafter advancing the feeding element further through said leading edge opening to remove the opposed portions of the material from the gripping elements;

withdrawing the material feeding element back through the leading edge of the tubular material leaving the tubular material displaced through the opening at the leading edge reverse-folded onto itself; and cutting the tubular material to separate the folded material from unfolded tubular material.

10. A method according to claim 9 including, after cutting the material, enabling the advancement of the material along the predetermined path for another reverse-folding cycle.

11. A method of reverse-folding tubular textile material onto itself comprising the steps of:

disposing tubular textile material for advancement along a predetermined path, the material having a leading edge;

separating a portion of the tubular material at its leading edge from an opposite portion thereof to define a leading edge opening;

disposing gripping elements into the leading edge opening of the material to engage opposed portions thereof by displacing the gripping elements into said opening in a direction generally opposite to the direction of advancement of the material along said predetermined path to engage the opposed portions of the material; and displacing said gripping elements and said opposed portions engaged thereby such that said opposed portions lie outwardly of margins of the tubular material lying along the predetermined path;

while said opposed portions lie outwardly of the margins of the tubular material, advancing a material feeding element engageable with the tubular material to advance the tubular material along the predetermined path into and through the leading edge opening and between the opposed portions thereof, thereby causing the material to reverse-fold onto itself;

stopping the advancement of the tubular material through the leading edge opening while maintaining the opposed portions of the tubular material engaged by the gripping elements and thereafter advancing the feeding element further through said leading edge opening to remove the opposed portions of the material from the gripping elements;

withdrawing the material feeding element back through the leading edge of the tubular material leaving the tubular material displaced through the opening at the leading edge reverse-folded onto itself; and cutting the tubular material to separate the folded material from unfolded tubular material.

12. A method of reverse-folding tubular textile material onto itself comprising the steps of:

disposing tubular textile material for advancement along a predetermined path, the material having a leading edge;

separating a portion of the tubular material at its leading edge from an opposite portion thereof to define a leading edge opening;

disposing gripping elements into the leading edge opening of the material to engage opposed portions thereof;

displacing said gripping elements and said opposed portions engaged thereby such that said opposed portions lie outwardly of margins of the tubular material lying along the predetermined path;

while said opposed portions lie outwardly of the margins of the tubular material, advancing a material feeding element engageable with the tubular material to advance the tubular material along the predetermined path into and through the leading edge opening and between the opposed portions thereof, thereby causing the material to reverse-fold onto itself; and engaging the reverse-folded material after the feeding element has been advanced to a maximum;

thereafter withdrawing the material feeding element back through the leading edge of the tubular material leaving the tubular material displaced through the opening at the leading edge reverse-folded onto itself and engaged to preclude movement thereof in a direction opposite to the advancement of the material along said predetermined path; and cutting the tubular material to separate the folded material from the tubular material.

13. Apparatus for reverse-folding tubular textile material onto itself comprising:

a frame;

a textile feeding element carried by said frame for advancing tubular textile material along a predetermined path, the material having a leading edge defining a leading edge opening;

gripping elements carried by said frame for gripping opposed portions of the tubular textile material and displacing said opposed portions outwardly of margins of the tubular material lying along said predetermined path;

said textile feeding element being movable to advance the tubular textile material along said predetermined path into and through the leading edge opening thereof and between said gripping elements, thereby causing the material to reverse-fold onto itself; and a clamp being movable between open and closed positions for enabling and stopping movement, respectively, of the tubular textile material along the predetermined path, said clamping element being movable to a closed position to stop the material from movement along the predetermined path while simultaneously said textile feeding element advances along the predetermined path, enabling the textile feeding element to remove opposed portions of the material from the gripping elements in response to said advancement.

* * * * *